US011521633B2

(12) United States Patent
Liu

(10) Patent No.: US 11,521,633 B2
(45) Date of Patent: Dec. 6, 2022

(54) AUDIO PROCESSING FOR WIND NOISE REDUCTION ON WEARABLE DEVICES

(71) Applicant: Bose Corporation, Framingham, MA (US)

(72) Inventor: Yang Liu, Boston, MA (US)

(73) Assignee: Bose Corporation, Framingham, MA (US)

( * ) Notice: Subject to any disclaimer, the term of this patent is extended or adjusted under 35 U.S.C. 154(b) by 45 days.

(21) Appl. No.: 17/211,243

(22) Filed: Mar. 24, 2021

(65) Prior Publication Data

US 2022/0310107 A1 Sep. 29, 2022

(51) Int. Cl.
*G10L 21/0232* (2013.01)
*H04R 1/10* (2006.01)
(Continued)

(52) U.S. Cl.
CPC ..... *G10L 21/0224* (2013.01); *G10L 21/0232* (2013.01); *H04R 1/1083* (2013.01); *G10L 2021/02166* (2013.01)

(58) Field of Classification Search
CPC . G10L 21/00; G10L 21/0208; G10L 21/0216; G10L 21/0224; G10L 21/0232;
(Continued)

(56) References Cited

U.S. PATENT DOCUMENTS 9,532,138 B1 * 12/2016 Allen ..... H04R 3/005
2009/0034752 A1 * 2/2009 Zhang ..... H04R 3/005 381/92

(Continued)

FOREIGN PATENT DOCUMENTS

CN 112242148 A * 1/2021 ..... G10L 21/0208
WO 2021043412 A1 3/2021

OTHER PUBLICATIONS

Wahab et al. ,"Intelligent Dashboard with Speech Enhancement", International Conference on Information, Communications and Signal Processing, ICICS '97, Singapore, Sep. 9-12, p. 993-997 (Year: 1997).*

(Continued)

*Primary Examiner* — Leshui Zhang
(74) *Attorney, Agent, or Firm* — Bond, Schoeneck & King, PLLC

(57) ABSTRACT

A wind noise reduction system includes a delay and sum (DAS) beamformer, an MVDR beamformer, a wind detector, a GEV beamformer, and a fixed voice mixer. The DAS beamformer generates a first voice signal based on a first and second microphone signal. The MVDR beamformer generates a second voice signal based on the first and second microphone signals. The GEV beamformer generates a wind array voice signal based on the first and second microphone signals and an accelerometer signal. The wind detector generates a wind detection signal based on the first voice signal and the second voice signal. The fixed voice mixer generates an output voice signal based on a microphone array voice signal, the wind array voice signal, and the wind detector signal. If high winds are detected, the output voice signal includes elements of the wind array voice signal based in part on the accelerometer signal.

20 Claims, 6 Drawing Sheets

(51) Int. Cl.

| | |
|---|---|
| ***G10L 21/0216*** | (2013.01) |
| ***H04R 1/40*** | (2006.01) |
| ***H04R 3/00*** | (2006.01) |
| ***G10L 21/0208*** | (2013.01) |
| ***G10L 21/0224*** | (2013.01) |

(58) Field of Classification Search

CPC ... G10L 2021/02166; G10L 2021/0216; G10L 15/20; G10L 15/22; G10L 15/28; G10L 25/78; H04R 1/08; H04R 1/1083; H04R 1/40; H04R 1/406; H04R 3/00; H04R 3/005; H04R 25/407; H04R 25/554; H04R 29/005; H04R 2201/401

USPC ..... 704/233, 226, 237, 246; 381/92, 74, 26, 381/56, 61, 66, 312, 313, 316, 317, 318, 381/320, 91, 95, 111, 112, 113, 114, 115, 381/122, 123, 355, 356, 358; 700/94; 455/570, 569.1, 114.2, 220, 221, 222, 223

See application file for complete search history.

(56) References Cited

U.S. PATENT DOCUMENTS

| | | | | |
|---|---|---|---|---|
| 2014/0093091 | A1 | 4/2014 | Dusan et al. | |
| 2014/0270231 | A1* | 9/2014 | Dusan | G10L 25/90 381/74 |
| 2015/0170632 | A1* | 6/2015 | Olsson | H04R 3/005 381/71.6 |
| 2018/0090153 | A1 | 3/2018 | Hoshuyama et al. | |
| 2018/0268837 | A1* | 9/2018 | Ganeshkumar | H04R 1/1008 |
| 2019/0005977 | A1* | 1/2019 | Olsson | H04R 1/083 |

OTHER PUBLICATIONS

International Search Report and the Written Opinion of the International Searching Authority, PCT Application No. PCT/US2022/071290, pp. 1-12, dated Jul. 7, 2022.

* cited by examiner

AUDIO PROCESSING FOR WIND NOISE REDUCTION ON WEARABLE DEVICES

FIELD OF THE DISCLOSURE

The present disclosure is directed generally to audio processing for wind noise reduction on wearable audio devices.

BACKGROUND

One important aspect of a wearable audio device is the ability to capture voice audio from the wearer. Whether the captured speech is in the context of a voice call with another person, or entering a voice audio command in an electronic system, the clarity of the voice audio is important to the use of the device. Most wearable audio devices utilize one or more embedded microphones to capture the voice audio. However, devices such as audio eyeglasses or open ear headsets contain microphones which are exposed to the external environment. These microphones are particularly vulnerable to wind noise drowning out captured voice audio.

The wind noise issue may be exacerbated by wearable audio devices utilizing minimum variance distortionless response (MVDR) beamforming. Beamforming allows the audio sensors of the device to focus audio capture on particular spatial regions, such as the regions around the user's mouth. MVDR beamforming is often preferred due to its high performance in terms of clarity and naturalness, particularly in areas with some degree of diffused noise, such as a cafeteria setting. However, the characteristics of MVDR beamforming can cause significant amplification of wind noise, sometimes to the point of overwhelming any captured voice audio.

Accordingly, there is a need for an audio processing system capable of reducing wind noise on wearable audio devices.

SUMMARY

This disclosure generally relates to audio processing for wind noise reduction on wearable audio devices.

Generally, in one aspect, a wind noise reduction system is provided. The wind noise reduction system may include a first beamformer. The first beamformer may be configured to generate a first voice signal. The first voice signal may be generated based on a first frequency domain microphone signal and a second frequency domain microphone signal. The first beamformer may be a delay and sum (DAS) beamformer.

The wind noise reduction system may further include a second beamformer. The second beamformer may be configured to generate a second voice signal. The second voice signal may be based on the first frequency domain microphone signal and the second frequency domain microphone signal. The second beamformer may be a minimum variance distortionless response (MVDR) beamformer.

The wind noise reduction system may further include a wind detector. The wind detector may be configured to generate a wind detection signal. The wind detection signal may be generated based on the first voice signal and the second voice signal.

The wind noise reduction system may further include a third beamformer. The third beamformer may be configured to generate a wind array voice signal. The wind array voice signal may be generated based on the first frequency domain microphone signal, the second frequency domain microphone signal, and a frequency domain accelerometer signal. According to an example, the third beamformer may be a generalized eigenvalue (GEV) beamformer.

The wind noise reduction system may further include a fixed voice mixer. The fixed voice mixer may be configured to generate an output voice signal. The output voice signal may be generated based on a microphone array voice signal, the wind array voice signal, and the wind detection signal. According to an example, the microphone array voice signal may correspond to the second voice signal.

According to an example, the wind noise reduction system may further include a dynamic voice mixer configured to generate the microphone array voice signal. The microphone array voice signal may be based on the first voice signal and the second voice signal. According to a further example, the microphone array voice signal may be further based on a first energy level of the first voice signal and a second energy level of the second voice signal.

According to an example, the wind noise reduction system may further include a filter bank. The filter bank may be configured to generate the first frequency domain microphone signal. The first frequency domain microphone signal may be generated based on a first time domain microphone signal.

The filter bank may be further configured to generate the second frequency domain microphone signal. The second frequency domain microphone signal may be generated based on a second time domain microphone signal.

The filter bank may be further configured to generate the frequency domain accelerometer signal. The frequency domain accelerometer signal may be generated based on a time domain accelerometer signal.

According to an example, the wind noise reduction system may further include a first microphone. The first microphone may be further configured to generate the first time domain microphone signal. The wind noise reduction system may further include a second microphone. The second microphone may be further configured to generate the second time domain microphone signal. The wind noise reduction system may further include an accelerometer. The accelerometer may be further configured to generate the time domain accelerometer signal.

According to an example, the wind detection signal may be a no wind detected signal or a low wind detected signal. The output voice signal may correspond to the microphone array voice signal.

According to an example, the wind detection signal may be a high wind detected signal. The output voice signal may correspond to a blended voice signal. The blended voice signal may be based on the microphone array voice signal and the wind array voice signal.

According to an example, the wind detection signal may be a no wind detected signal or a low wind detected signal. The output voice signal may correspond to the first frequency domain microphone signal and/or the second frequency domain microphone signal.

According to an example, the output voice signal may correspond to the first frequency domain microphone signal if the first frequency domain microphone signal has a first signal-to-noise ratio (SNR) greater than a second SNR of the second frequency domain microphone signal. The output voice signal may correspond to the second frequency domain microphone signal if the first SNR is less than the second SNR. The output voice signal may correspond to a blended microphone signal if the SNR is substantially equal to the second SNR. The blended microphone signal may be based on the first frequency domain microphone signal and the second frequency domain microphone signal.

Generally, in another aspect, a wearable audio device is provided. The wearable audio device may be a pair of audio eyeglasses or an open ear headset.

The wearable audio device may include a first microphone. The first microphone may be configured to generate a first time domain microphone signal.

The wearable audio device may include a second microphone. The second microphone may be configured to generate a second time domain microphone signal.

The wearable audio device may include an accelerometer. The accelerometer may be configured to generate a time domain accelerometer signal.

The wearable audio device may include a filter bank. The filter bank may be configured to generate a first frequency domain microphone signal based on the first time domain microphone signal. The filter bank may be further configured to generate a second frequency domain microphone signal based on the second time domain microphone signal. The filter bank may be further configured to generate a frequency domain accelerometer signal based on the time domain accelerometer signal.

The wearable audio device may include a first beamformer. A first beamformer may be configured to generate a first voice signal. The first voice signal may be based on the first frequency domain microphone signal and the second frequency domain microphone signal. The first beamformer may be a DAS beamformer.

The wearable audio device may include a second beamformer. The second beamformer may be configured to generate a second voice signal. The second voice signal may be based on the first frequency domain microphone signal and the second frequency domain microphone signal. The second beamformer may be a MVDR beamformer.

The wearable audio device may include a third beamformer. The third beamformer may be configured to generate a wind array voice signal. The wind array voice signal may be based on the first frequency domain microphone signal, the second frequency domain microphone signal, and a frequency domain accelerometer signal. The third beamformer may be a GEV beamformer.

The wearable audio device may include a wind detector. The wind detector may be configured to generate a wind detection signal. The wind detection signal may be based on the first voice signal and the second voice signal.

The wearable audio device may include a fixed voice mixer. The fixed voice mixer may be configured to generate an output voice signal. The output voice signal may be based on a microphone array voice signal, the wind array voice signal, and the wind detection signal. According to an example, the microphone array voice signal is the second voice signal.

According to an example, the wearable audio device may include a dynamic voice mixer. The dynamic voice mixer may be configured to generate the microphone array voice signal. The microphone array voice signal may be based on the first voice signal and the second voice signal.

Generally, in another aspect, a method for reducing wind noise is provided. The method may include generating, via a first beamformer, a first voice signal based on a first frequency domain microphone signal and a second frequency domain microphone signal. The method may further include generating, via a second beamformer, an second voice signal based on the first frequency domain microphone signal and the second frequency domain microphone signal. The method may further include generating, via a wind detector, a wind detection signal based on the first voice signal and the second voice signal. The method may further include generating, via a third beamformer, a wind array voice signal based on the first frequency domain microphone signal, the second frequency domain microphone signal, and a frequency domain accelerometer signal. The method may further include generating, via a fixed voice mixer, an output voice signal based on a microphone array voice signal, the wind array voice signal, and the wind detection signal.

According to an example, the method may further include generating, via a first microphone, the first time domain microphone signal. The method may further include generating, via a second microphone, the second time domain microphone signal. The method may further include generating, via an accelerometer, the time domain accelerometer signal. The method may further include generating, via a filter bank, the first frequency domain microphone signal based on a first time domain microphone signal. The method may further include generating, via the filter bank, the second frequency domain microphone signal based on a second time domain microphone signal. The method may further include generating, via the filter bank, the frequency domain accelerometer signal based on a time domain accelerometer signal.

According to an example, the method may further include, generating, via a dynamic voice mixer, the microphone array voice signal based on the first voice signal and the second voice signal.

According to an example, the first beamformer may be a DAS beamformer, the second beamformer may be an MVDR beamformer, and the third beamformer may be a GEV beamformer.

Other features and advantages will be apparent from the description and the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various examples.

DETAILED DESCRIPTION

This disclosure generally relates to audio processing for wind noise reduction on wearable audio devices. A wearable audio device captures spoken voice audio from a wearer via two microphones and an accelerometer, such as a voice band accelerometer, mounted on the device. The device uses a first beamformer, such as a Delay and Sum (DAS) beamformer, to generate a first voice signal based on audio captured by the microphones. The device also uses a second beamformer, such as a minimum variance distortionless response (MVDR) beamformer, to generate a second voice signal based on audio captured by the microphones. The device also uses a third beamformer, such as a generalized eigenvalue (GEV) beamformer, to generate a third voice signal based on the audio captured by the microphones and the accelerometer.

A wind detector then compares the voice signals of the first two beamformers to determine the degree of wind present. If no wind or low wind is present, the output voice signal corresponds to either the second voice signal or a blend of the first and second voice signals. If high wind is present, the output voice signal corresponds to a blend of the second and third voice signals. Using the accelerometer audio in high wind conditions allows for improved signal-to-noise (SNR) performance at low frequencies, while limiting the amplification of wind noise via an MVDR beamformer. Switching back to MVDR beamformed audio (or a blend of MVDR beamformed audio and DAS beamformed audio) in no wind or low wind conditions provides improved clarity and naturalness in such conditions.

Figure 1:
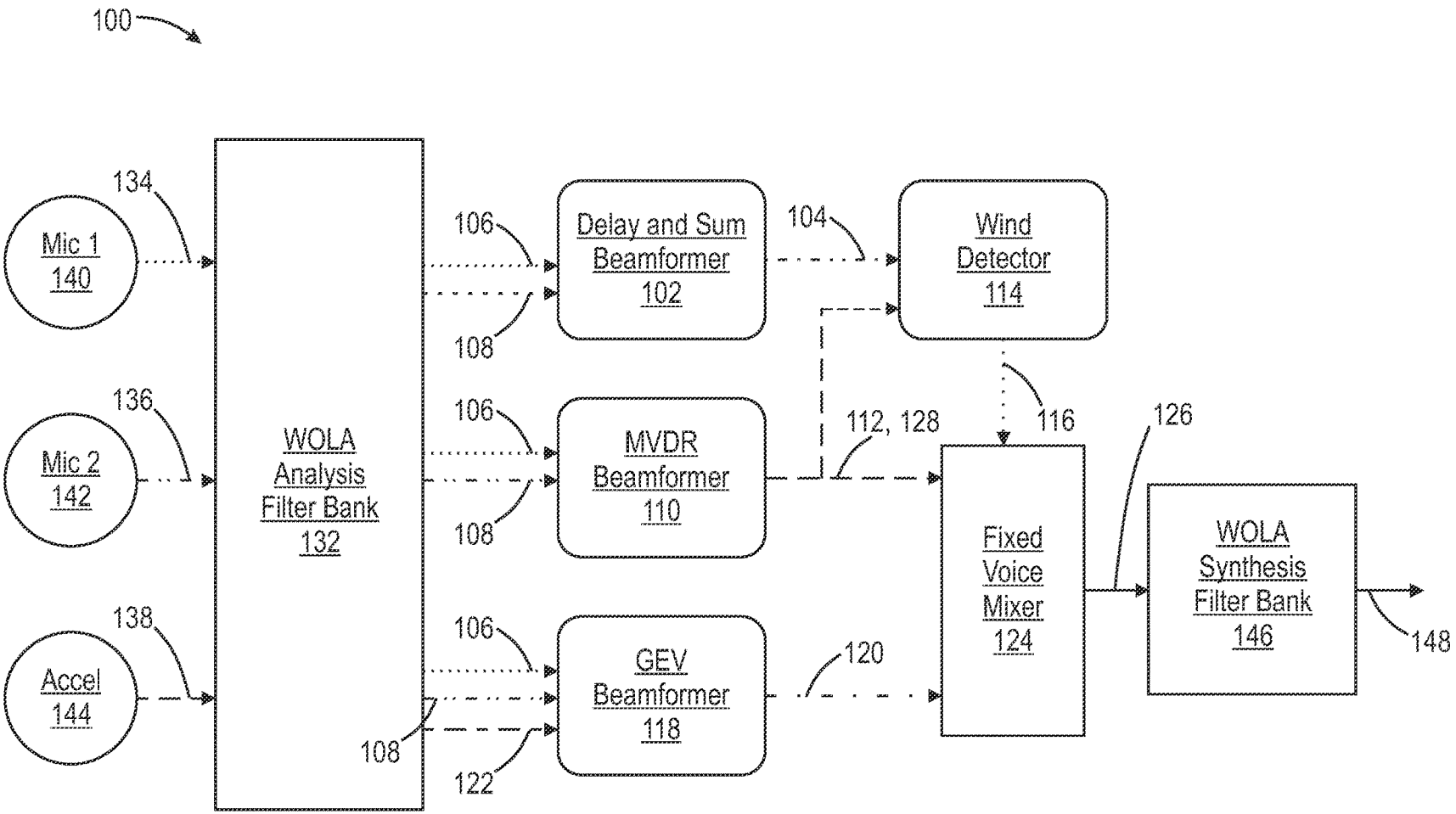
FIG. 1 is a first signal processing diagram of a system for audio processing, according to an example.

Generally, in one aspect, a wind noise reduction system 100 is provided. An example wind noise reduction system 100 is shown in FIG. 1. Broadly, the system 100 is configured to process audio captured by audio sensors, such as microphones 140, 142 and accelerometers 144. This captured audio may correspond to the speech of a user wearing a wearable audio device which includes the system 100. The system 100 processes this captured audio to reduce wind noise in windy conditions, while still providing high quality output audio in no wind or low wind conditions. The system 100 produces an output signal which may be further processed and transmitted according to a variety of implementations. For example, if the user is engaged in a telephone call with another party, the resulting audio may be transmitted to the other party via a cellular network. In another example, if the user is interacting with an electronic voice command system, the resulting audio may be transmitted to the voice command system via a Wi-Fi network, local area network (LAN), or wide area network (WAN).

As shown in FIG. 1, the wind noise reduction system 100 may include a first microphone 140, a second microphone 142, an accelerometer 144, a filter bank 132, a first beamformer 102 (such as a DAS beamformer), a second beamformer 110 (such as an MVDR beamformer, a wind detector 114, and a fixed voice mixer 124. The wind noise reduction system 100 processes audio captured by the first microphone 140, the second microphone 142, and the accelerometer 144 to produce an output voice signal 126. The output voice signal 126 may be further processed and transmitted according to a variety of implementations.

As used herein, the term "beamformer" generally refers to a filter or filter array used to achieve directional signal transmission or reception. In the examples described in the present application, the beamformers combine audio signals received by multiple audio sensors (such as microphones and accelerometers) to focus on a desired spatial region, such as the region around the wearer's mouth. While different types of beamformers utilize different types of filtering, beamformers generally achieve directional reception by filtering the received signals such that, when combined, the signals received from the desired spatial region constructively interfere, while the signals received from the undesired spatial region destructively interfere. This interference results in an amplification of the signals from the desired spatial region, and rejection of the signals from the undesired spatial region. The desired constructive and destructive interference is generally achieved by controlling the phase and/or relative amplitude of the received signals before combining. The filtering may be implemented via one or more integrated circuit (IC) chips, such as a field-programmable gate array (FPGA). The filtering may also be implemented using software.

As shown in FIG. 1, the wind noise reduction system may include a first beamformer 102. In a preferred example, the first beamformer 102 may be a DAS beamformer. A DAS beamformer focuses on a spatial region by adding delays to signals captured by the microphones in the array to compensate for varying physical distance from the targeted spatial region.

The first beamformer 102 may be configured to generate a first voice signal 104. The first voice signal 104 may be generated based on a first frequency domain microphone signal 106 and a second frequency domain microphone signal 108. The first frequency domain microphone signal 106 corresponds to audio captured by the first microphone 140, while the second frequency domain microphone signal 108 corresponds to audio captured by the second microphone 142. Accordingly, the microphone array used to form the first voice signal 104 includes the first 140 and second 142 microphones. If the system includes additional microphones, the audio captured from the additional microphones may also be used by the first beamformer 102 to generate the first voice signal 104.

As shown in FIG. 1, the wind noise reduction system 100 may further include a second beamformer 110. The second beamformer may be an MVDR beamformer. The algorithm employed by the MVDR beamformer minimizes the power of the noise captured by a microphone array while keeping the desired signal distortionless. In doing so, MVDR beamformers can provide improved SNR performance over DAS beamformers in diffused noise environments, such as a cafeteria-type setting. However, in high wind environments, MVDR beamformers may amplify wind noise as much as 10 to 20 dB at certain frequencies, thus negatively impacting SNR performance of resultant beamformed signals. As described below, this variation in wind performance may be utilized to detect the presence of wind in the environment of the wind noise reduction system 100.

The second beamformer 110 may be configured to generate a second voice signal 112. The second voice signal 112 may be based on the first frequency domain microphone signal 106 and the second frequency domain microphone signal 108. As with the first beamformer 102, the first frequency domain microphone signal 106 corresponds to audio captured by the first microphone 140, while the second frequency domain microphone signal 108 corresponds to audio captured by the second microphone 142. Accordingly, the microphone array used to form the second voice signal 112 includes the first 140 and second 142 microphones. If the system includes additional microphones, the audio captured from the additional microphones may also be used by the second beamformer 110 to generate the second voice signal 112.

As shown in FIG. 1, the wind noise reduction system 100 may further include a wind detector 114. The wind detector 114 is configured to determine the wind conditions of the environment by comparing the signals generated by two beamformers, such as the DAS beamformer 102 and the MVDR beamformer 110. Other types of beamformers may be used when appropriate.

The wind detector 114 may be configured to generate a wind detection signal 116. The wind detection signal 116 may be a binary signal, indicating whether or not wind is present above a specified detection threshold. In further examples, the wind detection signal 116 may contain information regarding the strength of the wind, such as "high wind" or "low wind".

The wind detection signal 116 may be generated based on the first voice signal 104 and the second voice signal 112. The first voice signal 104 may be generated by the DAS beamformer. The second voice signal 112 may be generated by the MVDR beamformer. As described above, MVDR beamformers are susceptible to amplifying wind noise as much as 10 to 20 dB at certain frequencies. Accordingly, if the second signal 112 contains significantly higher energy than the first signal 104, wind may be detected. The difference in energy levels between the first voice signal 104 and the second voice signal 112 may be proportional to the wind level. For example, a difference of 5 dB may be indicative of low winds, and a difference of 10 dB may be indicative of high winds.

The wind noise reduction system 100 may further include a third beamformer 118. The third beamformer 118 may be a GEV beamformer. The goal of the third beamformer 118 is to generate a wind array voice signal 120 which incorporates audio captured by an accelerometer 144. Accelerometers provide greater SNR performance than microphones in windy conditions, particularly at frequencies less than 1.0 to 2.0 kHz.

The wind array voice signal 120 may be generated based on the first frequency domain microphone signal 106, the second frequency domain microphone signal 108, and a frequency domain accelerometer signal 122. As with the first 102 and second 110 beamformers, the first frequency domain microphone signal 106 corresponds to audio captured by the first microphone 140, while the second frequency domain microphone signal 108 corresponds to audio captured by the second microphone 142. The frequency domain accelerometer signal 122 corresponds to accelerometer 144.

Figure 2:
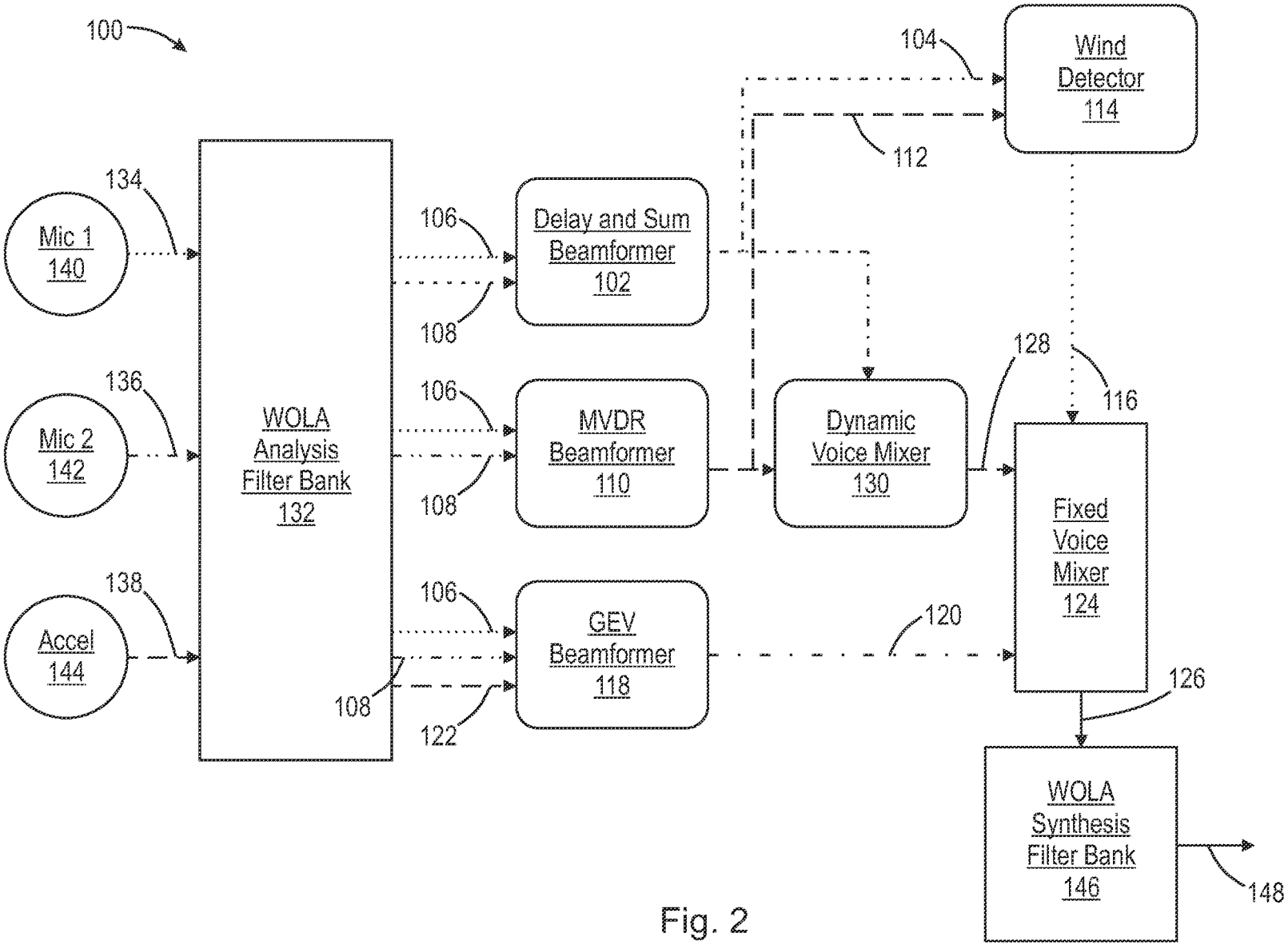
FIG. 2 is a second signal processing diagram of a system for audio processing, according to an example.

As shown in FIG. 1, the wind noise reduction system 100 may further include a fixed voice mixer 124. The fixed voice mixer 124 is configured to generate an output voice signal 126 based on wind conditions conveyed by the wind detector 114. In no wind or low wind conditions, the output voice signal 126 may correspond to either, as shown in FIG. 1, the second voice signal 112 (as generated by the MVDR beamformer) or, as shown in FIG. 2, a blend of the first voice signal 104 (as generated by the DAS beamformer) and the second voice signal 112. In high wind conditions the output voice signal 126 may correspond to a blended voice signal based on the wind array voice signal 120 and either the second voice signal 112 or the blend of the first voice signal 104 and the second voice signal 112. In a further example, the output voice signal 126 undergoes further downstream processing, and is eventually transmitted to a receiving device, such as a cell tower, Wi-Fi router, or another external device, such as a smartphone.

The fixed voice mixer 124 may be configured to generate an output voice signal 126. The output voice signal 126 may be generated based on a microphone array voice signal 128, the wind array voice signal 120, and the wind detection signal 116. According to an example shown in FIG. 1, the microphone array voice signal 128 may correspond to the second voice signal 112.

According to an example, and with reference to FIG. 2, the wind noise reduction system 100 may further include a dynamic voice mixer 130. In this example, the dynamic voice mixer is configured to generate the microphone array voice signal 128. The microphone array voice signal 128 is subsequently transmitted to the fixed voice mixer 124. The microphone array voice signal 128 may be based on the first voice signal 104 (generated by the DAS beamformer 102) and the second voice signal 112 (generated by the MVDR beamformer 110). The microphone array voice signal may be further based on a first energy level of the first voice signal 104 and a second energy level of the second voice signal 112. For example, if the second energy level is significantly higher than the first energy level (and thus indicative of high amounts of wind noise), the microphone array voice signal 128 may correspond to the first voice signal 104. In a further example, the microphone array voice signal 128 may be based on the voice signal 104, 112 with the highest SNR ratio.

According to an example, and as shown in FIG. 1, the wind noise reduction system 100 may further include a filter bank 132. The filter bank 132 is configured to transform the audio signals 134, 136, 138 generated by the microphones 140 and accelerometer 144 to frequency domain. In one example, the filter bank 132 may be a Weighted, Overlap, and Add (WOLA) Analysis filter bank.

The filter bank 132 may be configured to generate the first frequency domain microphone signal 106. The first frequency domain microphone signal 106 may be generated based on a first time domain microphone signal 134. The filter bank 132 may be further configured to generate the second frequency domain microphone signal 108. The second frequency domain microphone signal 108 may be generated based on a second time domain microphone signal 136. The filter bank 132 may be further configured to generate the frequency domain accelerometer signal 122. The frequency domain accelerometer signal 122 may be generated based on a time domain accelerometer signal 138.

In a further example, and as shown in FIG. 1, a second filter bank 146 may be used to transform the output voice signal 126 from a frequency domain signal to a time domain output voice signal 148 before further processing and/or transmission. In one example, the second filter bank 146 may be a WOLA Synthesis filter bank.

According to an example, and as shown in FIG. 1, the wind noise reduction system 100 may further include a first microphone 140 and a second microphone 142. Using multiple microphones 140, 142 allows the system 100 to utilize beamformers 102, 110 to focus on capturing audio from certain spatial regions, such as around the mouth of a user. The first 140 and second 142 microphones may be embedded in or mounted on a wearable audio device 200, such as a set of audio eyeglasses or an open ear headset. The microphones 140, 142 may be of any type suitable for capturing spoken audio from the user of the wearable audio device 200. The first microphone 140 may be configured to generate the first time domain microphone signal 134. The second microphone 142 may be configured to generate the second time domain microphone signal 136. Additional microphones and/or microphone arrays may be used to generate additional time domain microphone signals where appropriate.

The wind noise reduction system 100 may further include an accelerometer 144. According to an example, the accelerometer 144 may be a voice band accelerometer, rather than an inertial accelerometer configured to measure proper acceleration of a body. The voice band accelerometer is configured to capture audio in the frequency range of a human voice. The system 100 utilizes the accelerometer 144 due to its superior low frequency SNR performance in windy conditions as compared to a microphone 140, 142. Accordingly, the accelerometer 144 may be further configured to generate the time domain accelerometer signal 138.

According to an example, if the wind detection signal 116 is a no wind detected signal or a low wind detected signal, the output voice signal 126 generated by the fixed voice mixer 124 may correspond to the microphone array voice signal 128. As described above, and as shown in FIG. 1, the microphone array voice signal 128 may correspond to the second voice signal 112 generated by the second (MVDR) beamformer 110. Alternatively, and as shown in FIG. 2, the microphone array voice signal 128 may be generated by the dynamic voice mixer 130 based on the first voice signal 104 (generated by the DAS beamformer 102) and the second voice signal 112 (generated by the MVDR beamformer 110). Accordingly, in low or no wind conditions, the system 100 outputs a voice signal 126 based on the audio captured by the first 140 and second microphones 142.

According to an example, if the wind detection signal 116 is a high wind detected signal, the output voice signal 126 generated by the fixed voice mixer 124 may be a blended voice signal based on the microphone array voice signal 128 and the wind array voice signal 120. The blended voice signal may combine the low frequency portion (for example, below 1.3 kHz) of the wind array voice signal 120 with the high frequency portion (for example, above 1.3 kHz) of microphone array signal 128. In a further example, the blended voice signal may have an overlap frequency range (such as between 1.0 to 1.6 kHz) mixing together the wind array voice signal 120 and the microphone array signal 128. The fixed voice mixer 124 may ramp up or ramp down the wind array voice 120 and/or the microphone array signal 128 in this frequency range to generate a more fluid blend. Accordingly, in high wind conditions, the system 100 outputs a voice signal 126 based on the audio captured by the accelerometer 144 and the first 140 and second 142 microphones.

Figure 3:
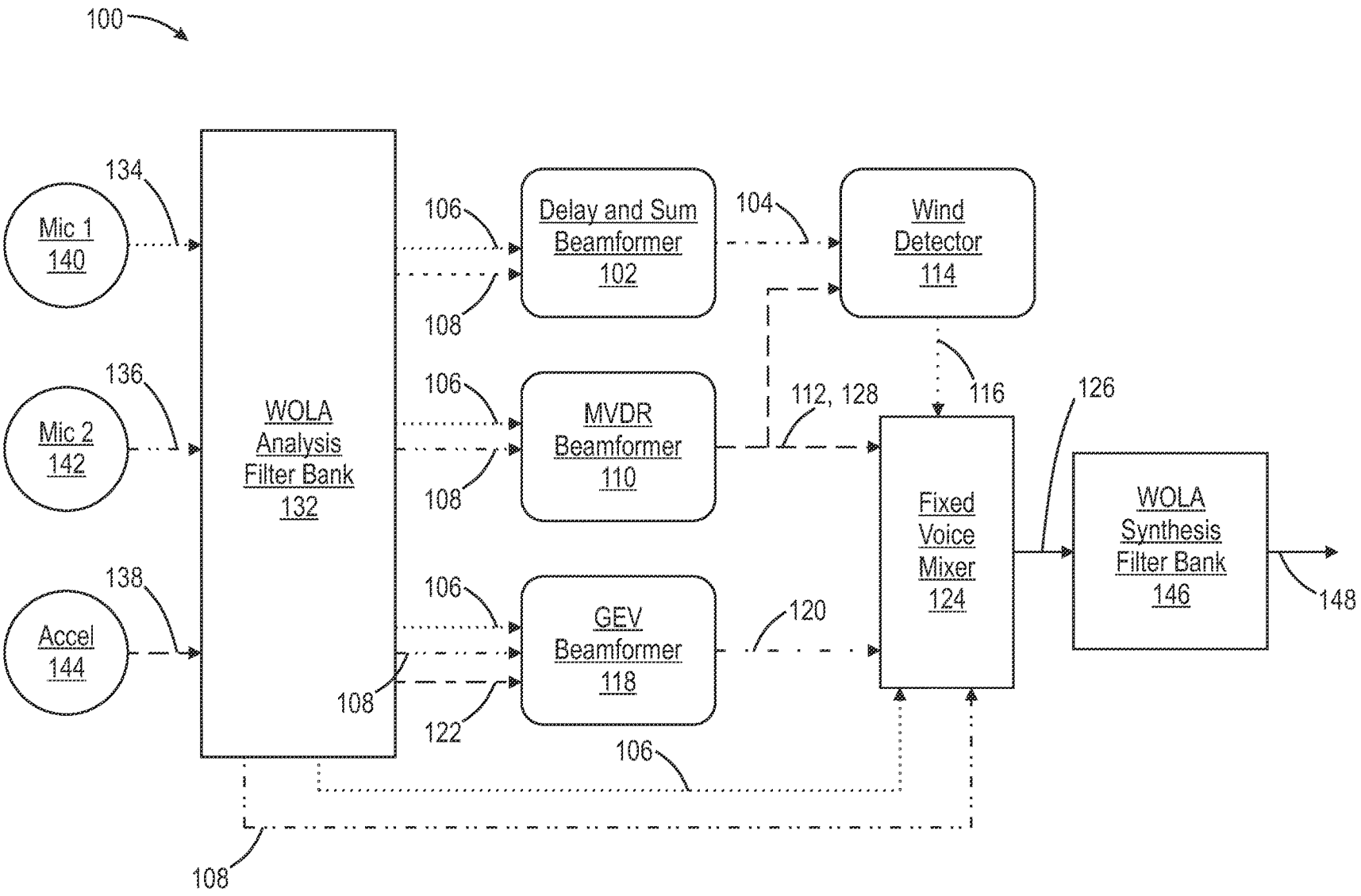
FIG. 3 is a third signal processing diagram of a system for audio processing, according to an example.

According to an example, and as shown in FIG. 3, if the wind detection signal 116 is a low wind detected signal or a no wind detected signal, the output voice signal 126 generated by the fixed voice mixer 124 may correspond to the first frequency domain microphone signal 106 and/or the second frequency domain microphone signal 108. In most low wind or no wind situations, the use of audio captured by the accelerometer 144 is unnecessary. However, the low wind may still be windy enough to negatively impact the beamforming of the MVDR beamformer 110 due to unintended amplification of wind noise. In these situations, the fixed voice mixer 116 may be programmed to generate an output voice signal 126 simply corresponding to the audio captured by the first 140 and/or second 142 microphone rather than a beamformed signal.

The microphone signal(s) chosen by the fixed output voice mixer 124 may be chosen based on SNR. According to an example, the output voice signal 126 may correspond to the first frequency domain microphone signal 106 if the first frequency domain microphone signal 106 has a first SNR greater than a second SNR of the second frequency domain microphone signal 108. Further, the output voice signal may correspond to the second frequency domain microphone signal 108 if the first SNR is less than the second SNR. The output voice signal 126 may correspond to a blended microphone signal if the first SNR is substantially equal to the second SNR. The blended microphone signal may be based on the first frequency domain microphone signal 106 and the second frequency domain microphone signal 108.

Figure 4:
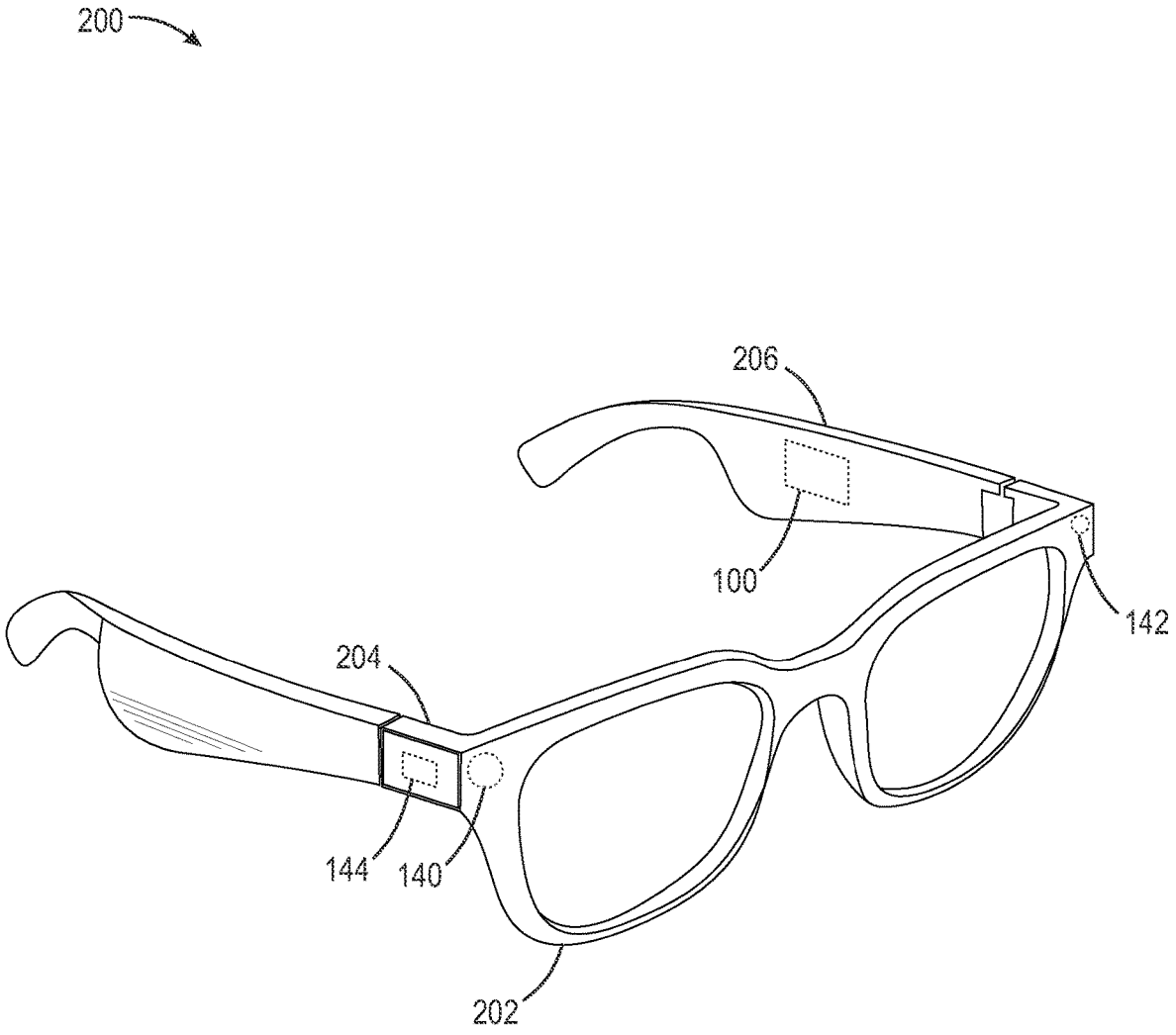
FIG. 4 is an isometric view of audio eyeglasses, according to an example.

Generally, in another aspect, and as shown in FIG. 4, a wearable audio device 200 is provided. As shown in FIG. 4, the wearable audio device 200 may be a pair of audio eyeglasses. In a further example, the wearable audio device 200 may be an open ear headset. The first microphone 140, the second microphone 142, and the accelerometer 144 may be mounted on or embedded in the wearable audio device 200. In the example of FIG. 4, the microphones 140, 142 are fixed to the top corners of the front face 202 of the wearable audio device 200, while the accelerometer is fixed to a temple connector 204 of the front face. The circuitry comprising the various aspects of the wind noise reduction system 100 may be embedded into a temple 206 of the wearable audio device 200.

Figure 5:
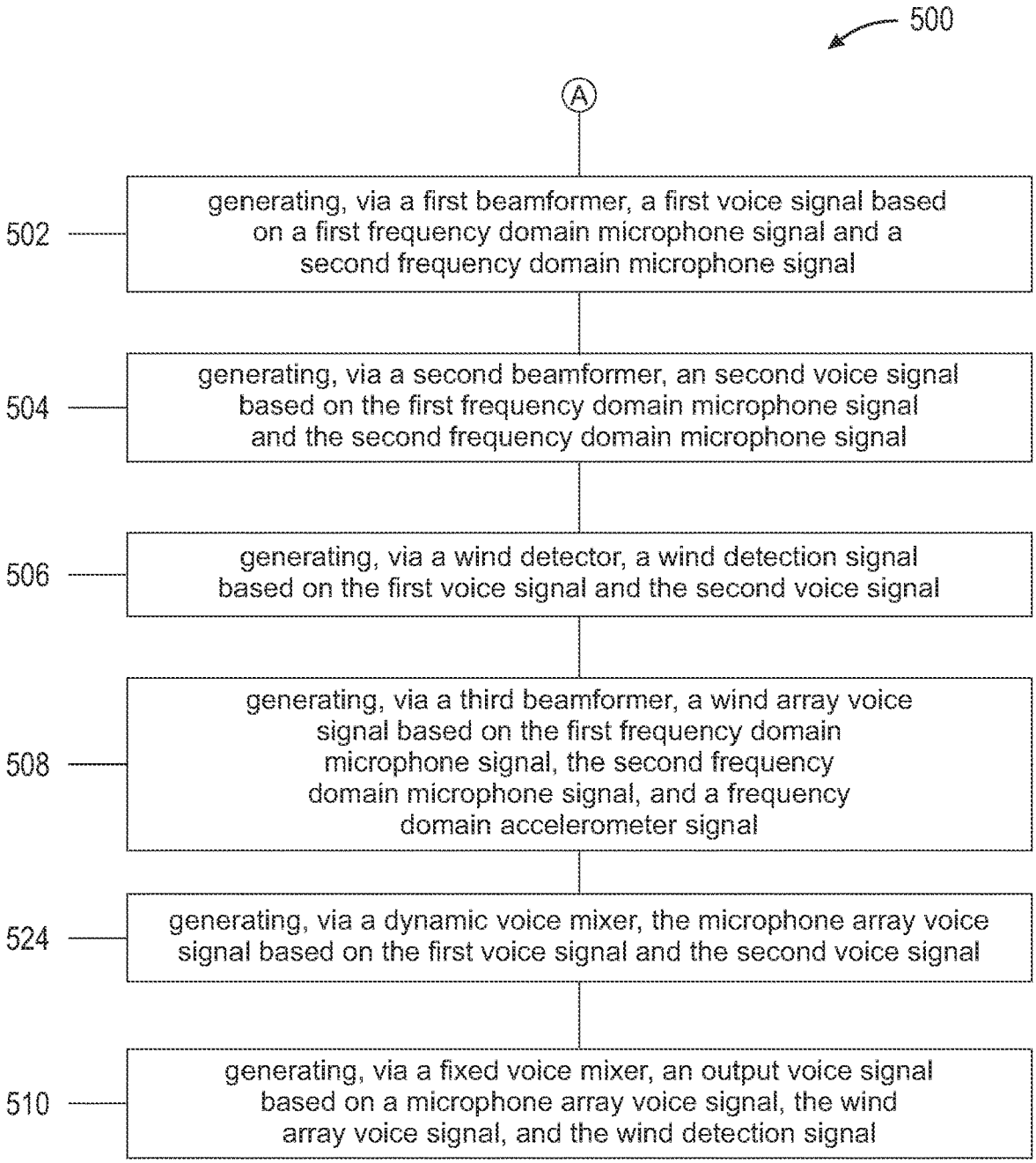
FIG. 5 is a flowchart of a method for audio processing, according to an example.

Generally, in another aspect, and as shown in FIG. 5, a method 500 for reducing wind noise is provided. The method 500 may include generating 502, via a first beamformer, a first voice signal based on a first frequency domain microphone signal and a second frequency domain microphone signal. The method 500 may further include generating 504, via a second beamformer, an second voice signal based on the first frequency domain microphone signal and the second frequency domain microphone signal. The method 500 may further include generating 506, via a wind detector, a wind detection signal based on the first voice signal and the second voice signal. The method 500 may further include generating 508, via a third beamformer, a wind array voice signal based on the first frequency domain microphone signal, the second frequency domain microphone signal, and a frequency domain accelerometer signal. The method 500 may further include generating 510, via a fixed voice mixer, an output voice signal based on a microphone array voice signal, the wind array voice signal, and the wind detection signal.

Figure 6:
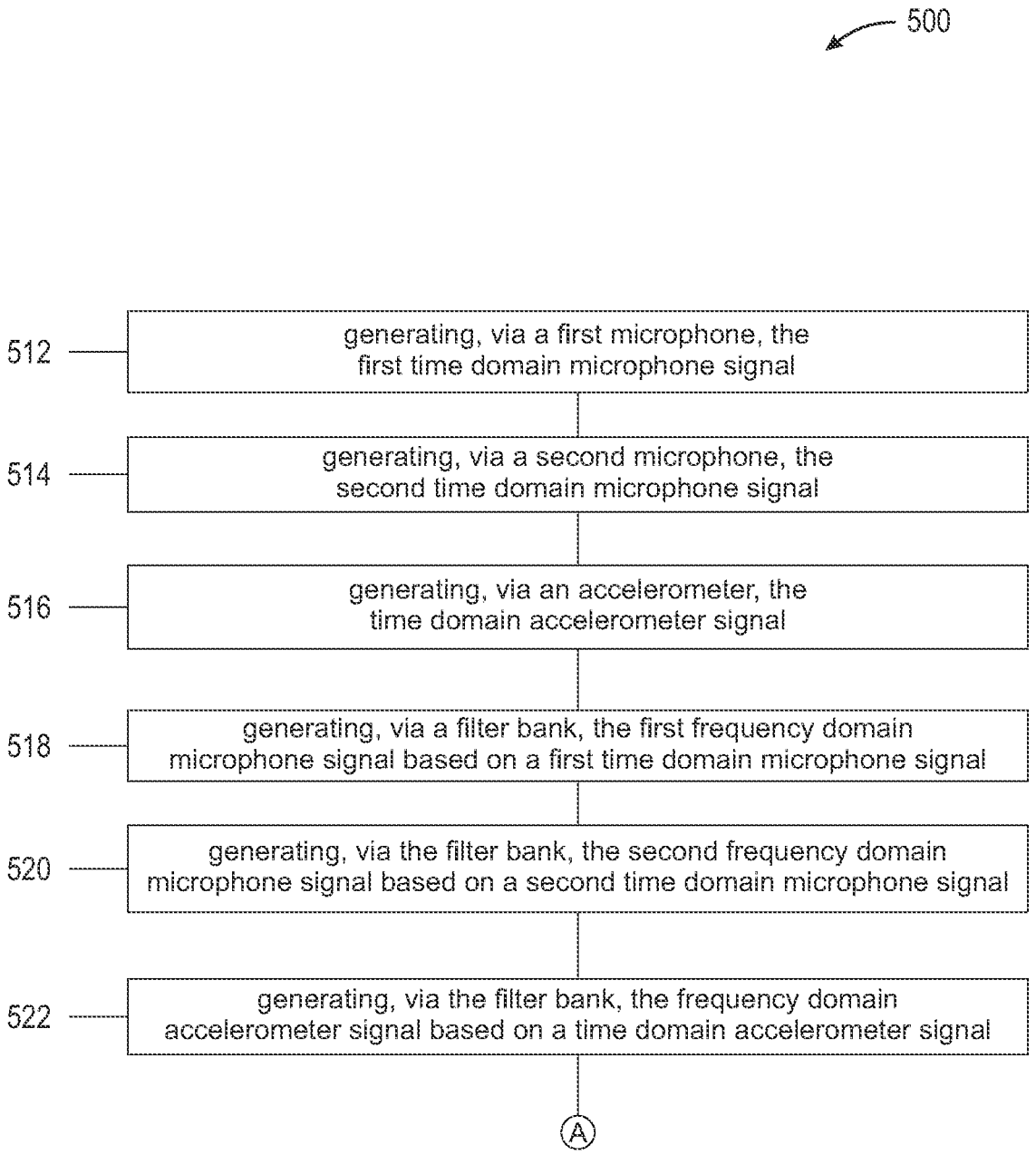
FIG. 6 is a further flowchart of a method audio processing, according to an example.

According to an example, and as shown in FIG. 6, the method 500 may further include generating 512, via a first microphone, the first time domain microphone signal. The method 500 may further include generating 514, via a second microphone, the second time domain microphone signal. The method 500 may further include generating 516, via an accelerometer, the time domain accelerometer signal. The method 500 may further include generating 518, via a filter bank, the first frequency domain microphone signal based on a first time domain microphone signal. The method 500 may further include generating 520, via the filter bank, the second frequency domain microphone signal based on a second time domain microphone signal. The method 500 may further include generating 522, via the filter bank, the frequency domain accelerometer signal based on a time domain accelerometer signal.

According to an example, and as shown in FIG. 5 the method 500 may further include, generating 524, via a dynamic voice mixer, the microphone array voice signal based on the first voice signal and the second voice signal.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of" "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The above-described examples of the described subject matter can be implemented in any of numerous ways. For example, some aspects may be implemented using hardware, software or a combination thereof. When any aspect is implemented at least in part in software, the software code can be executed on any suitable processor or collection of processors, whether provided in a single device or computer or distributed among multiple devices/computers.

The present disclosure may be implemented as a system, a method, and/or a computer program product at any possible technical detail level of integration. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some examples, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to examples of the disclosure. It will be understood that each block of the flowchart illustrations and/or block diagrams, and combinations of blocks in the flowchart illustrations and/or block diagrams, can be implemented by computer readable program instructions.

The computer readable program instructions may be provided to a processor of a, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various examples of the present disclosure. In this regard, each block in the flowchart or block diagrams may represent a module, segment, or portion of instructions, which comprises one or more executable instructions for implementing the specified logical function (s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Other implementations are within the scope of the following claims and other claims to which the applicant may be entitled.

While various examples have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the examples described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific examples described herein. It is, therefore, to be understood that the foregoing examples are presented by way of example only and that, within the scope of the appended claims and equivalents thereto, examples may be practiced otherwise than as specifically described and claimed. Examples of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

What is claimed is:

1. A wind noise reduction system, comprising:

a first beamformer configured to generate a first voice signal based on a first frequency domain microphone signal and a second frequency domain microphone signal;

a second beamformer configured to generate a second voice signal based on the first frequency domain microphone signal and the second frequency domain microphone signal;

a wind detector configured to generate a wind detection signal based on the first voice signal and the second voice signal;

a third beamformer configured to generate a wind array voice signal based on the first frequency domain microphone signal, the second frequency domain microphone signal, and a frequency domain accelerometer signal; and a fixed voice mixer configured to generate an output voice signal based on a microphone array voice signal, the wind array voice signal, and the wind detection signal.

2. The wind noise reduction system of claim 1, wherein the microphone array voice signal is the second voice signal.

3. The wind noise reduction system of claim 1, further comprising a dynamic voice mixer configured to generate the microphone array voice signal based on the first voice signal and the second voice signal.

4. The wind noise reduction system of claim 3, wherein the microphone array voice signal is further based on a first energy level of the first voice signal and a second energy level of the second voice signal.

5. The wind noise reduction system of claim 1, wherein the first beamformer is a delay and sum (DAS) beamformer, the second beamformer is a minimum variance distortionless response (MVDR) beamformer, and the third beamformer is a generalized eigenvalue (GEV) beamformer.

6. The wind noise reduction system of claim 1, further comprising a filter bank configured to:

generate the first frequency domain microphone signal based on a first time domain microphone signal;

generate the second frequency domain microphone signal based on a second time domain microphone signal; and generate the frequency domain accelerometer signal based on a time domain accelerometer signal.

7. The wind noise reduction system of claim 6, further comprising:

a first microphone configured to generate the first time domain microphone signal;

a second microphone configured to generate the second time domain microphone signal; and an accelerometer configured to generate the time domain accelerometer signal.

8. The wind noise reduction system of claim 1, wherein the wind detection signal is a no wind detected signal or a low wind detected signal, and further wherein the output voice signal corresponds to the microphone array voice signal.

9. The wind noise reduction system of claim 1, wherein the wind detection signal is a high wind detected signal, and further wherein the output voice signal corresponds to a blended voice signal, wherein the blended voice signal is based on the microphone array voice signal and the wind array voice signal.

10. The wind noise reduction system of claim 1, wherein the wind detection signal is a no wind detected signal or low wind detected signal, and further wherein the output voice signal corresponds to the first frequency domain microphone signal and/or the second frequency domain microphone signal.

11. The wind noise reduction system of claim 10, wherein the output voice signal corresponds to the first frequency domain microphone signal if the first frequency domain microphone signal has a first signal-to-noise ratio (SNR) greater than a second SNR of the second frequency domain microphone signal, further wherein the output voice signal corresponds to the second frequency domain microphone signal if the first SNR is less than the second SNR, further wherein the output voice signal corresponds to a blended microphone signal if the first SNR is substantially equal to the second SNR, and further wherein the blended microphone signal is based on the first frequency domain microphone signal and the second frequency domain microphone signal.

12. A wearable audio device, comprising:

a first microphone configured to generate a first time domain microphone signal;

a second microphone configured to generate a second time domain microphone signal;

an accelerometer configured to generate a time domain accelerometer signal;

a filter bank configured to generate a first frequency domain microphone signal based on the first time domain microphone signal, generate a second frequency domain microphone signal based on the second time domain microphone signal, and a frequency domain accelerometer signal based on the time domain accelerometer signal;

a first beamformer configured to generate a first voice signal based on the first frequency domain microphone signal and the second frequency domain microphone signal;

a second beamformer configured to generate a second voice signal based on the first frequency domain microphone signal and the second frequency domain microphone signal;

a third beamformer configured to generate a wind array voice signal based on the first frequency domain microphone signal, the second frequency domain microphone signal, and a frequency domain accelerometer signal;

a wind detector configured to generate a wind detection signal based on the first voice signal and the second voice signal; and a fixed voice mixer configured to generate an output voice signal based on a microphone array voice signal, the wind array voice signal, and the wind detection signal.

13. The wearable audio device of claim 12, wherein the wearable audio device is a pair of audio eyeglasses or open ear headset.

14. The wearable audio device of claim 12, wherein the first beamformer is a delay and sum (DAS) beamformer, the second beamformer is a minimum variance distortionless response (MVDR) beamformer, and the third beamformer is a generalized eigenvalue (GEV) beamformer.

15. The wearable audio device of claim 12, wherein the microphone array voice signal is the second voice signal.

16. The wearable audio device of claim 12, further comprising a dynamic voice mixer configured to generate the microphone array voice signal based on the first voice signal and the second voice signal.

17. A method for reducing wind noise, comprising:

generating, via a first beamformer, a first voice signal based on a first frequency domain microphone signal and a second frequency domain microphone signal;

generating, via a second beamformer, a second voice signal based on the first frequency domain microphone signal and the second frequency domain microphone signal;

generating, via a wind detector, a wind detection signal based on the first voice signal and the second voice signal;

generating, via a third beamformer, a wind array voice signal based on the first frequency domain microphone signal, the second frequency domain microphone signal, and a frequency domain accelerometer signal; and generating, via a fixed voice mixer, an output voice signal based on a microphone array voice signal, the wind array voice signal, and the wind detection signal.

18. The method of claim 17, further comprising:

generating, via a first microphone, a first time domain microphone signal;

generating, via a second microphone, a second time domain microphone signal;

generating, via an accelerometer, a time domain accelerometer signal;

generating, via a filter bank, the first frequency domain microphone signal based on the first time domain microphone signal;

generating, via the filter bank, the second frequency domain microphone signal based on the second time domain microphone signal; and generating, via the filter bank, the frequency domain accelerometer signal based on the time domain accelerometer signal.

19. The method of claim 17, further comprising generating, via a dynamic voice mixer, the microphone array voice signal based on the first voice signal and the second voice signal.

20. The method of claim 17, wherein the first beamformer is a delay and sum (DAS) beamformer, the second beamformer is a minimum variance distortionless response (MVDR) beamformer, and the third beamformer is a generalized eigenvalue (GEV) beamformer.

* * * * *